US005853339A

United States Patent [19]

Scerbo

[11] Patent Number: 5,853,339

[45] Date of Patent: Dec. 29, 1998

[54] FOOTBALL PRACTICE AID

[75] Inventor: Louis Scerbo, Nutley, N.J.

[73] Assignee: Wing-It Inc., Nutley, N.J.

[21] Appl. No.: 888,580

[22] Filed: Jul. 7, 1997

Related U.S. Application Data

[63] Continuation-in-part of Ser. No. 660,208, Jun. 3, 1996, abandoned.

[51] Int. Cl.[6] ..... A63B 43/02

[52] U.S. Cl. ..... 473/576

[58] Field of Search ..... 473/430, 576

[56] References Cited

U.S. PATENT DOCUMENTS

| | | | |
|---|---|---|---|
| 667,563 | 2/1901 | Oakley | 473/576 |
| 733,024 | 7/1903 | Gamble | 473/576 |
| 3,514,109 | 5/1970 | Grow | 473/576 |
| 3,593,998 | 7/1971 | Pattyn | 473/576 |
| 3,804,409 | 4/1974 | Schachner | 473/576 |
| 3,940,133 | 2/1976 | Civita | 473/576 |
| 4,127,268 | 11/1978 | Lindgren | 473/576 |
| 5,452,888 | 9/1995 | Glenn | 473/576 |
| 5,611,532 | 3/1997 | Forrest | 473/576 |

*Primary Examiner*—Theatrice Brown
*Attorney, Agent, or Firm*—Ross, Ross & Flavin

[57] ABSTRACT

A practice device for the throwing of a football, the device consisting of a football and an elasticized cord and an adjustable wrist support band with a means for connecting the cord between the football at one extremity and the wristband at its opposite extremity in combination with a means for causing to develop a spiralling trajectory when thrown.

1 Claim, 3 Drawing Sheets

FOOTBALL PRACTICE AID

CROSS REFERENCES TO RELATED APPLICATIONS

This application is a continuation-in-part of related application, Ser. No. 08/660,208 filed Jun. 3, 1996 (abandoned).

BACKGROUND OF THE INVENTION

1. Field of the Invention

The invention pertains to a practice device permitting an athelete to throw a football as a pass thrown spirally and forwardly toward a receiver, each so-thrown ball being returnable to the thrower, the ball being tethered.

The salient advantage of the apparatus is that it serves as a practice tool for training not only throwers in the art of throwing but also receivers in the art of receiving spirally thrown balls.

The ball may be thrown with different levels of velocity, being increased or decreased according to the improving ability of the thrower.

One primary object hereof is to simulate in flight the spiral path of a regular thrown football in which the ball rotates on its long axis while moving through the air.

The mechanism allows for the development of a maximum of control in the art of throwing a ball toward an intended target.

By the ball retrieving system, the thrown ball may be immediately returned to the player for a succeeding throw thereof.

2. Description of the Prior Art

The developed art to date has revealed the following patents:

| | | |
|---|---|---|
| U.S. Pat. No. 667,563 | Feb. 5, 1901 | Oakley |
| U.S. Pat. No. 672,099 | Apr. 16, 1901 | Jackson |
| U.S. Pat. No. 733,024 | July 7, 1903 | Gamble |
| U.S. Pat. No. 3,804,409 | Apr. 16, 1974 | Schachner |
| U.S. Pat. No. 3,940,133 | Feb. 24, 1976 | Civita |
| U.S. Pat. No. 4,127,268 | Nov. 28, 1978 | Lindgren |
| U.K. 2,263,408 | July 28, 1993 | Webb |

None of the references show the specific construction of the ball hereof.

SUMMARY OF THE INVENTION

The description will set forth rather broadly the more important features of the present invention in order that the invention may be better understood, and in order that the present contributions to the art may be better appreciated.

Before explaining the invention in detail, it is understood that the invention is not limited in its application to the details of the construction and to the arrangements of the components set forth in the following description or illustrated in the drawings. The invention is capable of other embodiments and of being practiced and carried out in various ways. Also it is to be understood, that the phraseology and terminology employed herein are for the purpose of description and should not be regarded as limiting.

It is therefore the primary object of the present invention to provide a new and improved tethered ball apparatus which is capable of assuming a spiral path in its flight when thrown, the ball rotating on its long axis while moving through its trajectory.

This and other objects, aspects and features of the present invention will be better understood from the following detailed description of the preferred embodiment when read in conjunction with the appended drawing figures.

DESCRIPTION OF THE PREFERRED EMBODIMENT

Figure 1:
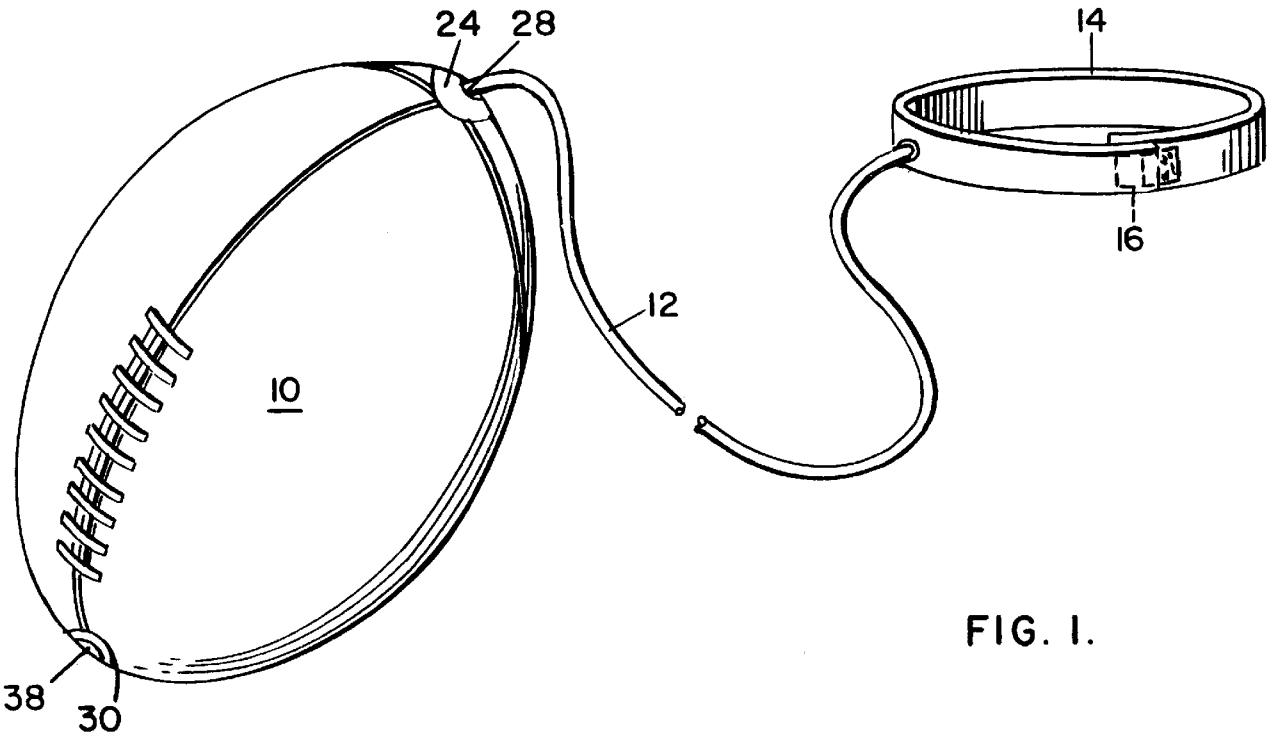
FIG. 1 is an axonemetric projection view of the mechanism of the invention.
Figure 3:
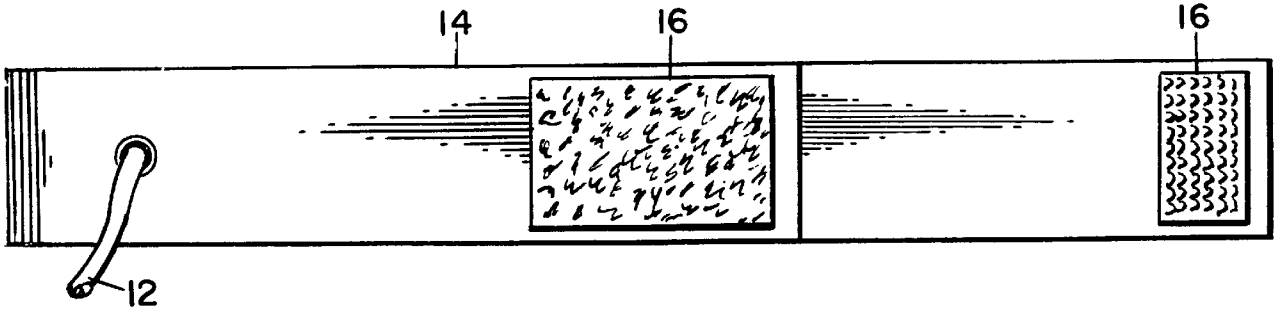
FIG. 3 is a plan view of the wristband of the invention.
Figure 2:
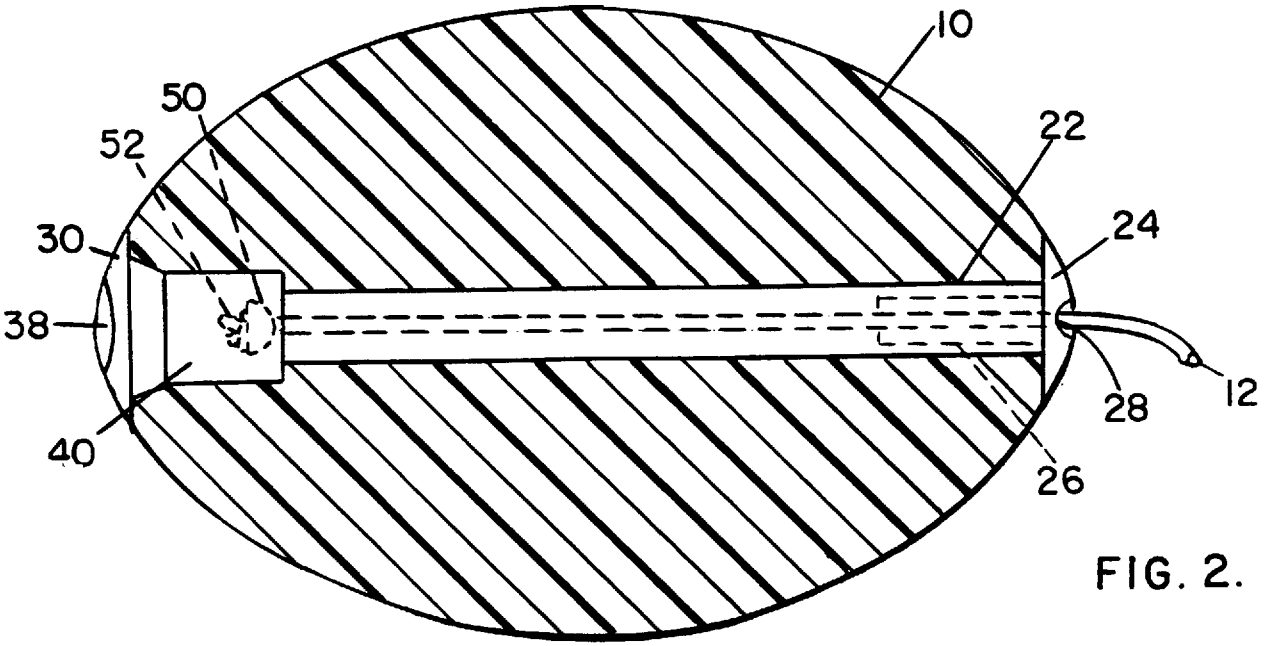
FIG. 2 is a sectional view through the center of the football of the invention.
Figure 8:
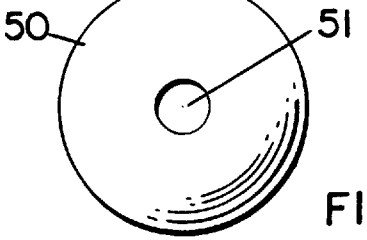
FIG. 8 is a bottom view of the swivel member.
Figure 7:
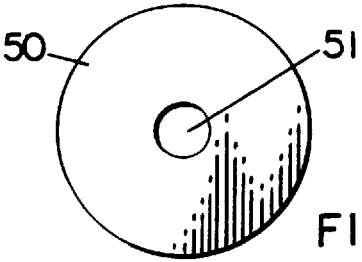
FIG. 7 is a top view of the swivel member.
Figure 6:
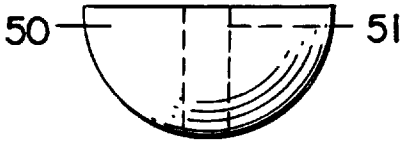
FIG. 6 is a side view of the swivel member.

In FIG. 1 is shown the complete ball retrieving apparatus wherein a football 10, of the well known size and shape is formed of a plastic foam material, and has the familiar ellipsoidal configuration. It is tethered by a length of elasticized bungy cord 12 which is connected at its opposite end to an adjustable wrist band 14 consisting of a flat, flexible rectangular-shaped member capable of being entrapped around the wrist of a thrower and having stitched thereto a pair of Velcro patches 16, which patches may be brought into confrontation with each other after the step of wrapping the band around the person's wrist has been completed, all to tie the tether to the thrower.

The ball is provided with a central end-to-end hollow chamber 20 along its longitudinal axis, into which chamber is seated an end-to-end plastic tube 22.

Figure 4:
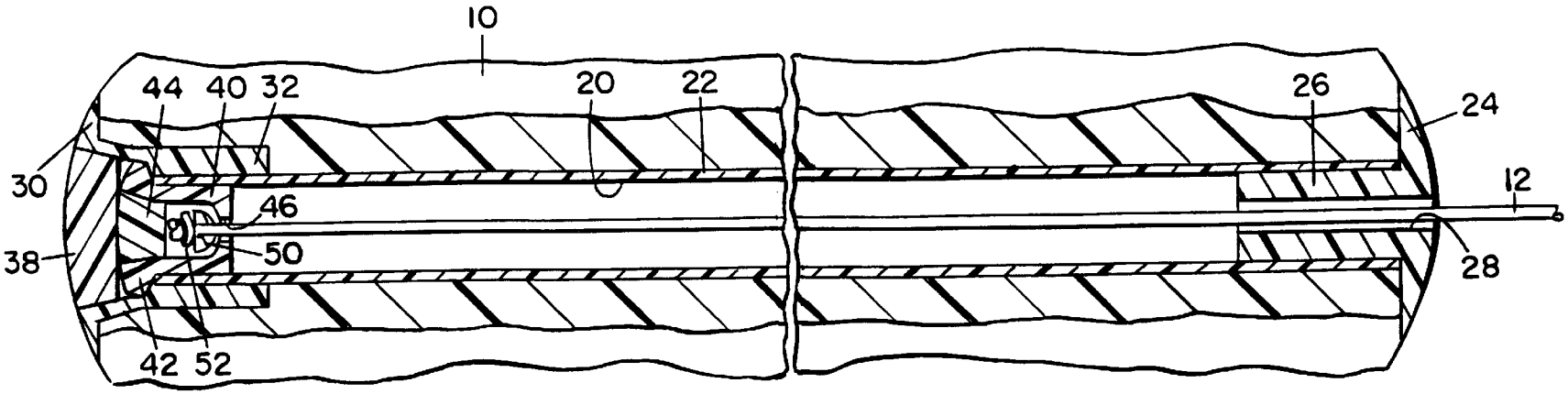
FIG. 4 is an enlarged, fragmentary longitudinal cross-sectional view taken centrally through the football.
Figure 5:
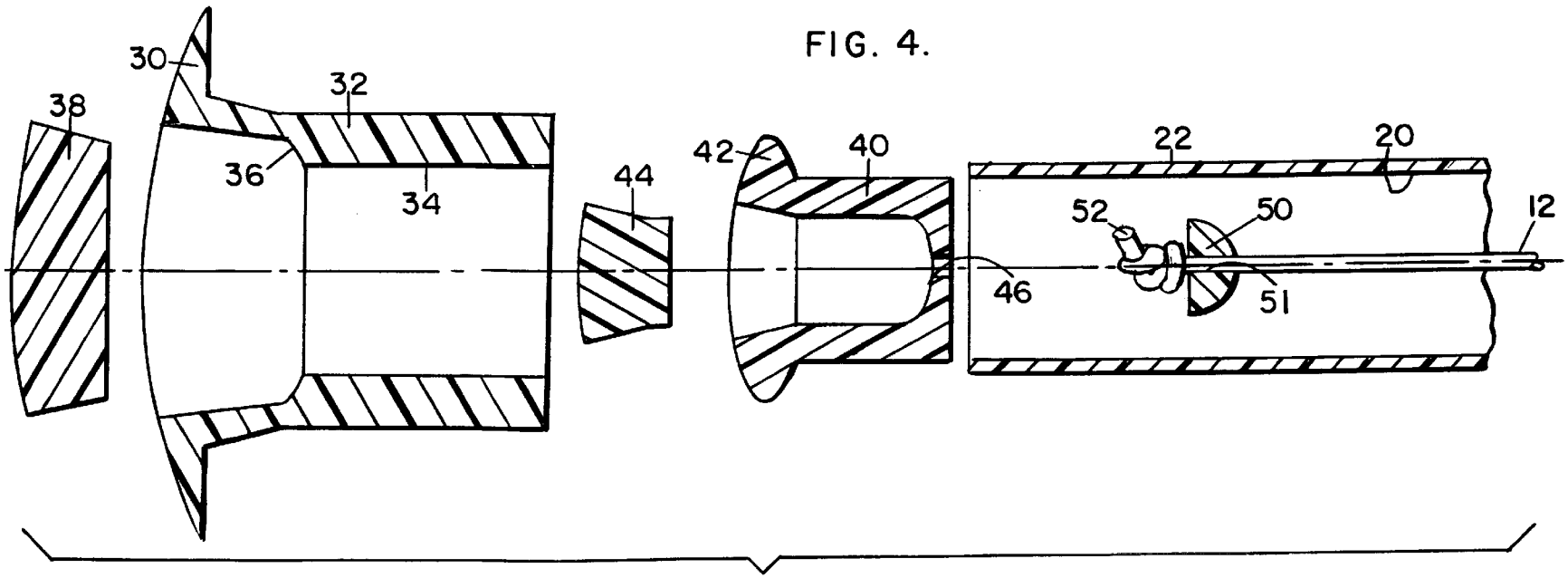
FIG. 5 is a greatly enlarged, exploded, fragmentary, cross-sectional view of the end cap cord anchor and swivel means to the leftward end of the mechanism of the invention.

At the rightward ball end, as viewed in FIG. 4, a right end cap 24, having a curved exterior surface conforming to the exterior surface of the ball, is provided for covering the nose of the ball in a hollow-chamber-enclosing manner. The right end cap also has a central, inwardly-projecting tubular extension 26 integral therewith, which extension snugly nests within the rightward terminus of tube 22, the extension diameter being slightly less than the tube diameter to allow this.

A throw opening 28 extends centrally of the end cap and extension.

At the leftward ball end, a left end cap 30, having a curved exterior surface for conforming to the exterior surface of the ball is provided for covering the opposite nose of the ball.

The left end cap has a central inwardly-projecting tubular extension 32 integral therewith, which extension is of a diameter so as to snugly fit around the exterior of the leftward terminus of tube 22.

The left end cap is provided with an enlarged central through opening 34 defining an annular shoulder 36 approximately midway therethrough.

An end cap plug 38 is nestably receivable within the outer end of the opening 34 of the left end cap.

A tubular swivel housing 40 is so dimensioned so as to be receivable within the left terminus of tube 22 and is provided with a flared outer annular rim 42 which is seatable upon the annular shoulder 36 of the left end cap.

A swivel housing plug 42 is nestably receivable within the outer opening of tubular swivel housing 40.

And a central opening 46 extends through the inner end wall of the swivel housing.

The end of the tether on assembly is extended through opening 28 in the right end cap 24, through the length of tube 22, and through opening 46 in the swivel housing.

The terminus of the tether has a cup shaped swivel 50 sleeved thereon, which swivel is held fast to the tether by virtue of a knot 52 formed at the extreme end of the tether, it being appreciated that swivel and tether terminus are disposed within the swivel housing when the arrangement is completely assembled.

The novel arrangement of the tubular guides, allows the bungy cord to spin freely within the ball and imparts the spiralling motion to the ball as it proceeds in its trajectory, when thrown.

An invention has been disclosed which fulfills the objects thereof as set forth hereinabove and provides a new and useful tethered football of novelty and utility.

Slight changes and modifications or alterations in the teachings hereof may be contemplated by those skilled in the art without departing from the intended spirit and scope thereof.

As such, it is intended that the present invention only be limited by the terms of the appended claims.

The arrangement is such that the tether is loosely confined within the football body and is anchored at the leftware end (as viewed in FIG. 4) so as to allow a swivelling motion of the left end cap when the ball is in operational use thereby defining a twisting trajectory when thrown.

I claim:

1. In a ball apparatus for players in the practice of throwing and receiving a ball, the thrown ball having a capacity for being returned to a player in an opposite direction comprising:

a thermoplastic ball of ellipsoidal configuration defining a first nose and a second nose at respective ends of the ball and having an end-to-end hollow chamber extending through the ball along its longitudinal axis, a first end cap having an apertured nose portion snugly covering the first nose and enclosing the chamber at said first end of the ball and having an integral central inwardly-projecting tubular portion received in the chamber and communicating with the aperture of the nose portion, a second end cap having a nose portion snugly covering the second nose and enclosing the chamber at a second end of the ball and having an integral central inwardly-projecting tubular portion received in the chamber, an end-to-end tubing seated in the chamber and communicating with the first and second end caps, an elongated elasticized tether loosely extending through the aperture in the first end cap and the tubing and into the tubular portion of the second end cap, swivel means seated within the tubular portion of the second end cap for anchoring one end of the tether in said ball while spiralling of the ball about said tether in its trajectory when thrown, and attachment means secured to another end of the tether for connecting with a player's wrist.

* * * * *